US006075313A

United States Patent [19]

Verheyen

[11] Patent Number: 6,075,313

[45] Date of Patent: Jun. 13, 2000

[54] INCANDESCENT LAMP HAVING FILAMENT WITH POLYGONAL TURNS

[75] Inventor: Jozef H. M. R. Verheyen, Turnhout, Belgium

[73] Assignee: U.S. Philips Corporation, New York, N.Y.

[21] Appl. No.: 09/006,568

[22] Filed: Jan. 13, 1998

[30] Foreign Application Priority Data

Jan. 15, 1997 [EP] European Pat. Off. ..... 97200118

[51] Int. Cl.[7] ..... H01K 1/18; H01K 1/10

[52] U.S. Cl. ..... 313/271; 313/578; 313/333; 445/48; 445/50

[58] Field of Search ..... 313/271, 272, 313/273, 333, 341, 343, 344, 244, 245, 246, 315, 316, 578, 275; 445/48, 50

[56] References Cited

U.S. PATENT DOCUMENTS

| | | | |
|---|---|---|---|
| 2,142,865 | 1/1939 | Zabel | 445/48 |
| 3,119,946 | 1/1964 | Kerstetter et al. | 445/50 |
| 3,788,721 | 1/1974 | Vause | 313/315 |
| 4,616,682 | 10/1986 | Groenewegen | 140/71.5 |
| 4,857,709 | 8/1989 | Janssen et al. | 219/464 |
| 5,523,650 | 6/1996 | Terheijden et al. | 313/578 |
| 5,556,191 | 9/1996 | Maassen | 362/256 |
| 5,565,734 | 10/1996 | Pinot | 313/578 |

FOREIGN PATENT DOCUMENTS

| | | | |
|---|---|---|---|
| 0560420 | 6/1996 | European Pat. Off. | H01K 1/32 |
| 1227377 | 9/1989 | Japan | H05B 3/10 |
| 2100506A | 12/1982 | United Kingdom | B65H 55/04 |

*Primary Examiner*—Nimeshkumar D. Patel
*Assistant Examiner*—Joseph Williams
*Attorney, Agent, or Firm*—F. Brice Faller

[57] ABSTRACT

The electric incandescent lamp has a tubular quartz glass lamp vessel (1) in which a filament (10) having adjoining turns is axially disposed. The filament (10) is kept centered in the lamp vessel (1) by supports (15) which are connected to the filament (10) intermediate its ends (12) and which bear against the lamp vessel (1). The turns (11) of the filament (10) are formed as polygons, and the adjacent angles of adjoining turns are angularly displaced relative to one another about the axis (2) of the lamp vessel (1).

5 Claims, 3 Drawing Sheets

INCANDESCENT LAMP HAVING FILAMENT WITH POLYGONAL TURNS

BACKGROUND OF THE INVENTION

The invention relates to an electric incandescent lamp comprising:

a tubular lamp vessel which is closed in a vacuumtight manner, which is made of glass having an $SiO_2$ content of at least 95% by weight, and which has an axis and seals on said axis;

a coiled tungsten incandescent body having turns and end portions, axially arranged in the lamp vessel;

support means between the end portions keeping the incandescent body centered in the lamp vessel and incandescent turns of that body spaced from the lamp vessel;

current conductors which enter the lamp vessel through respective seals and which are connected to respective end portions of the incandescent body.

Such an electric incandescent lamp is known from U.S. Pat. No. 5,523,650.

The known lamp is an IR radiator whose incandescent body is surrounded by quartz glass which comprises samarium$^{III}$ oxide and aluminum oxide so as to color it red. The lamp vessel may be linear or may be bent into a polygon which is open at one side. The incandescent body is helically coiled. Between the end portions several pieces of tungsten wire are present which are wound onto the incandescent body and which spiral to rest against the lamp vessel to act as support means in order to keep the incandescent body spaced from the lamp vessel. The reason why the support means separate the incandescent turns is that quartz glass is not capable of withstanding the temperature of the incandescent turns during operation when touched by these turns.

Such an IR lamp is known from EP-B-0 560 420, wherein a precursor in the quartz glass is converted into a red pigment by means of a heat treatment during the final manufacturing stages of the lamp.

From U.S. Pat. No. 5,565,734 an electric incandescent lamp of the kind described in the opening paragraph is known in which the support means consist of a refractory metal sleeve, short-circuiting turns of the incandescent body and of a constriction made in the lamp vessel and contacting the metal sleeve. As a result of the short-circuiting, these turns are relatively cold and do not incandesce.

U.S. Pat. No. 5,556,191 discloses such a lamp in which the tubular lamp vessel is accommodated in a mirror-coated outer envelope.

An IR radiator is known from U.S. Pat. No. 4,857,709 wherein the incandescent body is helically coiled with turns which are so large that the incandescent body rests against the wall of the lamp vessel substantially circumferentially. In that case the incandescent body must be designed so as to have only a comparatively low temperature during operation which the quartz glass is capable of withstanding. A disadvantage of this is, however, that the lamp can only be used in those applications where IR radiation of comparatively great wavelength is required as radiated by the incandescent body of comparatively low temperature. The large dimension of the turns of the incandescent body furthermore render it difficult to introduce the incandescent body into the lamp vessel.

These are also disadvantages inherent in the lamp known from JP-A-1-227.377. Here a bent quartz glass, for example colorless transparent lamp vessel contains an incandescent body which was coiled around a mandrel of unround cross-section and whose turns lie against the tubular wall of the lamp vessel. The turns have partly relaxed their stress after manufacture, so that the incandescent body, when viewed axially, shows a star shape and entirely or substantially entirely occupies the lamp vessel in cross-sections thereof.

IR radiators, but also floodlighting lamps, have the characteristic that they consume comparatively high powers, from a few hundreds to a few thousands of watts. The lamps and the incandescent bodies are comparatively long for this reason. Coiling a helical incandescent body around a round core, a mandrel or needle, is comparatively expensive. In the case of coiling around a continuous mandrel, this mandrel, for example made of molybdenum, must be removed after the coiling process in that by dissolving. It is accordingly advantageous to coil around a comparatively short needle, a portion having the length of one incandescent body being cut off periodically once it has been moved off the needle. It is necessary during this, however, to hold on to the turns on the needle so that the needle can still draw on uncoiled wire so as to coil it. If turns already made were not retained on the needle, in fact, they would relieve their stress on the round needle and lose their clamping force around the needle. The necessity of preventing this renders the coiling machine not only expensive but also comparatively slow. Such a method of manufacturing incandescent bodies is known, for example, from U.S. Pat. No. 4,616,682. In proportion as the incandescent body is longer, the machine costs of coiling, or the cost of the coiling mandrel, its dissolving after coiling, and the recovery of the mandrel material from the resulting solution will be higher.

SUMMARY OF THE INVENTION

It is an object of the invention to provide an electric incandescent lamp of the kind described in the opening paragraph which has a construction which is easy to manufacture.

According to the invention, the turns of the incandescent body are each formed as a polygon having a plurality of angles, and adjacent angle adjoining turns angularly displaced relative to one another about the axis.

Owing to the shape of its turns, the incandescent body can be easily and quickly manufactured by coiling a conductor around an angled core. A simple machine suffices for this, which causes an angled core to rotate and which comprises a pitch block, for example a stationary one, adjacent the core which determines the pitch of the conductor coiled around the core by means of a surface of this block which is at an angle to the core. It was found that in general only a few, for example two turns of the conductor around the core are sufficient for enabling the core to coil the conductor further. The turns already made need not be retained by additional means during this. Thanks to its angled shape, the core prevents the angled turns or the core from springing back under the influence of stresses caused in the conductor by the coiling process. The angled turns in fact hook themselves around the angled core and as a result cannot glide tangentially along this core and work themselves loose. The core is accordingly capable of coiling as yet uncoiled conductor wire around itself by its rotation thanks to the grip it exercises on the turns already made. The core may rotate at a high speed during this.

The core may be a comparatively short angled needle on which comparatively few turns are present. Turns pushed off the needle by turns made subsequently may be cut loose once they have achieved a total length equal to that of one incandescent body.

The moment the coiling core is no longer present inside the turns, the latter will spring back slightly at the corner points. Corresponding corner points will accordingly define a helical line which winds itself around the incandescent body. If the incandescent body was made on a triangular core, three such lines will wind themselves around the incandescent body. The incandescent body, viewed laterally, will show a pattern as a result of this, both with light shining through and in profile. Springing back of the turns results in the incandescent body providing the same luminous flux on all sides. This would not be the case if coiling stresses in the turns were removed in a heat treatment prior to the removal of the core from the incandescent body. In the latter case the incandescent body, for example having a prism shape, would radiate more light in directions perpendicular to the sides of the prism than in the intermediate directions during operation. Such an incandescent body would be of no use in a lamp which is to give the same luminous flux in all directions.

The coiling core, and thus the turns, may have various angular shapes in cross-section, such as triangular, quadrangular, or hexagonal. A regular shape is favorable, for example that of an equilateral triangle. It is also favorable when the corner points are rounded. This can be achieved by using a cylindrical body which has been given flat sides by grinding, which sides do not make contact with one another. Damage to the coiling wire is counteracted thereby, while the incandescent body is given turns with rounded corners between its sides.

It is important in the electric incandescent lamp according to the invention that the incandescent body thereof can be easily and quickly manufactured on a simple machine and that the incandescent body, provided with supports in a conventional manner, connected to current conductors, and mounted in a lamp vessel results in a conventional lamp, for example a floodlighting lamp or IR lamp. Cores of widely differing diameters may be used for the manufacture of the incandescent body, for example from 700 to 3000 $\mu$m or more, while a conductor of approximately 200 up to approximately 700 $\mu$m may be used. It is noted in this connection that a conductor can only be coiled around a core having a greater diameter than the conductor, as was previously the case. The diameter of the core is here understood to be the diameter of the smallest circumscribed circular cylinder of the core, i.e. the diameter of the round rod from which the core can be manufactured by grinding.

On first sight the electric incandescent lamp according to the invention does not differ from a conventional lamp. The tubular lamp vessel is internally a number of times wider than the incandescent body, for example three to ten times, for example eight times. The incandescent turns of the incandescent body are kept separate from the lamp vessel by support means and the body is centered in the lamp vessel. The incandescent body seems to be cylindrical. Upon closer observation of the incandescent body, however, a multiple threaded pattern is visible at its surface.

The support means may consist of e.g. pieces of tungsten wire, wound onto the incandescent body and spiralling to the lamp vessel, as is common in the kind of incandescent lamps. Alternatively, constrictions in the lamp vessel may be present, e.g. opposing indents, touching a non incandescent portion of the incandescent body. Such portions may be obtained by a refractory metal sleeve, e.g. of tungsten, short-circuiting some turns. Such portions may alternatively be obtained during the manufacture of the incandescent body in that the wire from which the body is made, is wound backwards over some turns just made and is subsequently wound forward again. The body thus locally has three superimposed layers of short-circuited turns.

DESCRIPTION OF THE PREFERRED EMBODIMENTS

Figure 1:
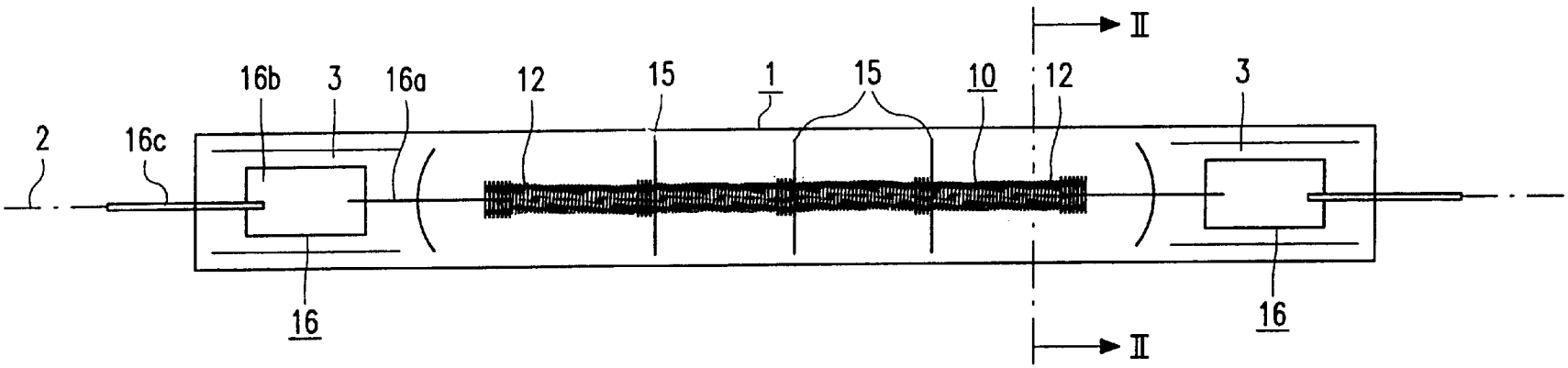
FIG. 1 shows the lamp in side elevation.

In FIG. 1, the electric incandescent lamp has a tubular lamp vessel 1 which is closed in a vacuumtight manner, which is made of glass with an $SiO_2$ content of at least 95% by weight, quartz glass in the Figure, and which has an axis 2 and seals 3 on this axis. A coiled tungsten incandescent body 10 with turns 11 and end portions 12 is axially arranged in the circular-cylindrical lamp vessel 1. Support means 15, in the Fig. pieces of tungsten wire connected to the incandescent body 10 between the end portions 12 thereof and resting against the lamp vessel 1, keep the incandescent body 10 centered in the lamp vessel 1 and incandescent turns spaced from the lamp vessel. The support means 15 each have a portion coiled around the incandescent body 10, as is usual, and integral therewith a portion which spirals out towards the lamp vessel 1. Current conductors 16 issue through respective seals 3, pinch seals in the Figure, into the lamp vessel 1 and are connected to respective end portions 12 of the incandescent body 10 by coiling around their respective end portion 12. The current conductors 16 are composite conductors in the Figure: an internal part 16*a,* for example made of tungsten, welded to a foil 16*b,* for example made of molybdenum, inside the seal 3, and an external part 16*c,* for example made of molybdenum, welded to the foil.

The lamp vessel 1 has a gas filling of argon/nitrogen which comprises hydrogen bromide.

Figure 2:
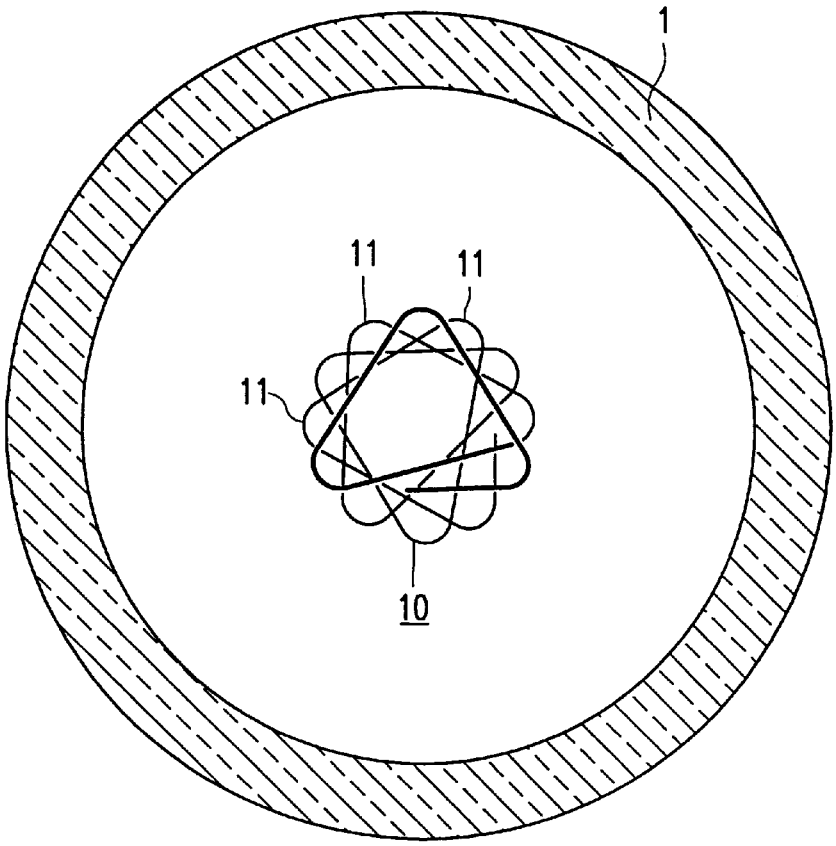
FIG. 2 is a schematic cross-section taken on the line II—II in FIG. 1.

The turns 11 of the incandescent body 10, see FIG. 2, are angular, and adjoining turns 11 are rotated relative to one another about the axis 2 in a regular pattern. The turns 11 have rounded corners and were coiled around a core having an equilateral cross-section, as is evident from FIG. 2.

The incandescent body was manufactured from wire having a diameter of 250 $\mu$m around a mandrel of 1750 $\mu$m which was ground into an equilateral prism with rounded edges, forming an equilateral triangle with rounded corner points in cross-section. The incandescent body was coiled with a mandrel velocity of 3500 rpm and has a length of 500 mm. The pitch block encloses an angle of 20° with the needle, so that the incandescent body has a pitch of 360 $\mu$m. The lamp shown is designed for use as an infrared radiator.

Another lamp had an incandescent body of similar construction designed to obtain a higher temperature during operation in order to emit white light and to be used as a flood-light lamp.

Figure 3:
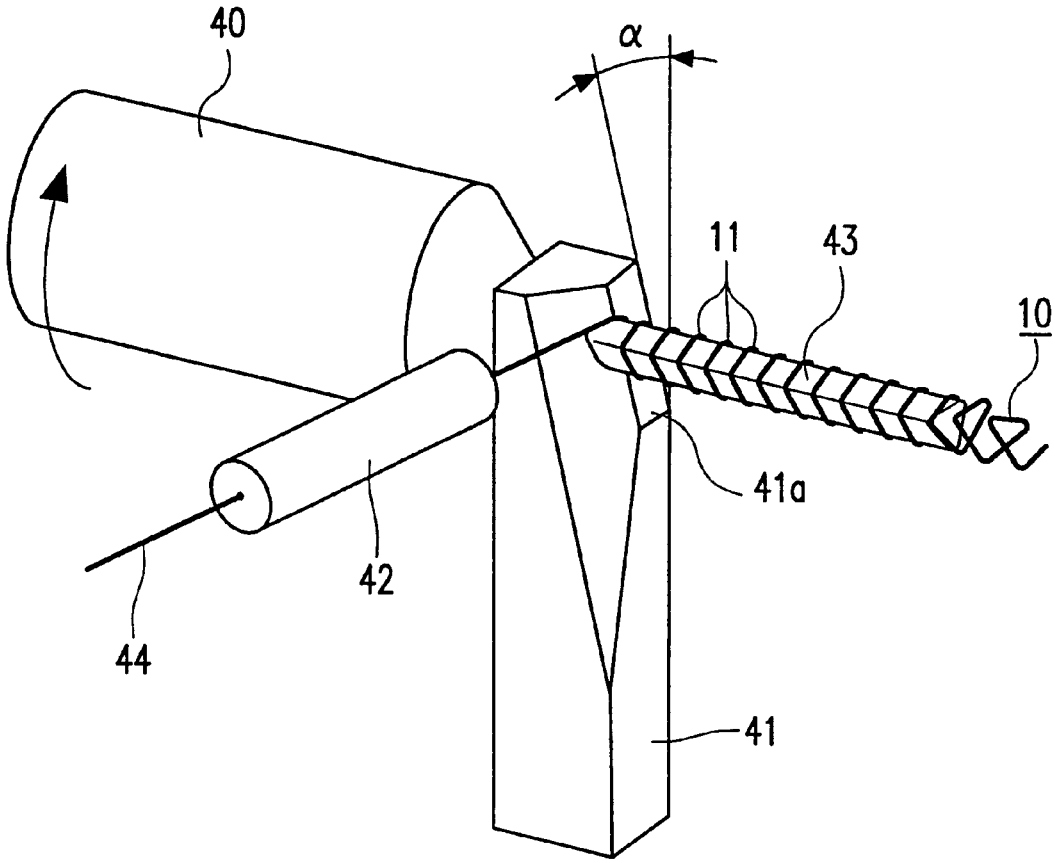
FIG. 3 diagrammatically shows the arrangement for manufacturing the incandescent body.

In FIG. 3, a holder 40 for a mandrel having a central axis and a polygonal cross-section 43, which is shown diagrammatically and which was obtained in that a cylindrical needle was symmetrically provided with three flat sides through grinding, is rotated in the direction indicated. A pitch block 41 is fixedly arranged around the mandrel 43. The pitch block has a guiding surface 41*a* which encloses an angle $\alpha$ with a perpendicular to the central axis of mandrel 43. A tungsten wire 44 is fed towards the needle 43 through a wire guide 42. The rotating needle 43 coils the wire 44 with a pitch defined by the pitch surface 41*a* into an incandescent body 10 which is diagrammatically drawn. The turns 11 still present on the mandrel 43 form a fitting, frictional connection to the mandrel 43, so that the wire 44 not yet coiled is wound around the mandrel 43 in spite of the absence of additional means other than the shape of the mandrel 43 and the resulting shape of the turns 11 for holding on to the turns 11, with the result that the mandrel 43 does not slip circumferentially in the turns 11. Whenever a further turn 11 is made, a previously made turn 11 slips off the mandrel 43 axially so as to form part of an incandescent body 10.

Figure 4:
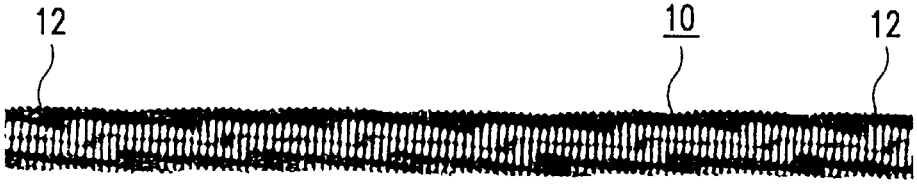
FIG. 4 is a side elevation of the incandescent body obtained in the coiling arrangement of FIG. 3.

FIG. 4 shows the pattern of the incandescent body 10 made through coiling of its wire around the symmetrical, triangular mandrel 43. The reflections of the light of the photocopying apparatus on which the picture was made on the incandescent body show a pattern with several threads, whereby the incandescent body distinguishes itself from a conventional incandescent body coiled around a round core.

I claim:

1. An electric incandescent lamp comprising:

a tubular lamp vessel (1) which is closed in a vacuumtight manner, which is made of glass having an $SiO_2$ content of at least 95% by weight, and which has an axis (2) and seals (3) on said axis;

a coiled tungsten incandescent body (10) having turns (11) and end portions (12), axially arranged in the lamp vessel (1), the turns each being formed as a polygon having a plurality of angles, adjacent angles of adjoining turns being angularly displaced relative to one another about the axis;

support means (15) between the end portions (12) keeping the incandescent body (10) centered in the lamp vessel (1) and incandescent turns (11) spaced from the lamp vessel (1); and current conductors (16) which enter the lamp vessel (1) through respective seals (3) and which are connected to respective end portions (12) of the incandescent body (10).

2. An electric incandescent lamp as claimed in claim 1, characterized in that the turns (11) have rounded corners.

3. An electric incandescent lamp as claimed in claim 1 wherein the turns (11) are formed as regular polygons.

4. Method for manufacturing a coiled incandescent body having turns which are each formed as a polygon having a plurality of angles, adjacent angles of adjoining turns being angularly displaced relative to one another about a central axis, said method comprising providing an elongate mandrel having a central axis and a polygonal cross-section, arranging a pitch block around the mandrel, said pitch block having a guiding surface which forms an acute angle with a perpendicular to said central axis, rotating said mandrel about said central axis, and feeding a wire toward said mandrel as it rotates, said wire being fed against said guiding surface transversely to said central axis and being wrapped around said mandrel, whereby turns are formed having a pitch defined by said acute angle, and each turn resiles angularly relative to each adjacent turn when said mandrel is removed.

5. Method as in claim 4 wherein, as each turn is made adjacent to said guiding surface, a previously made turn slips off said mandrel.

* * * * *